United States Patent [19]

Slade

[11] Patent Number: 4,521,024

[45] Date of Patent: Jun. 4, 1985

[54] APPARATUS FOR PLAYING A GAME

[75] Inventor: Brian P. Slade, Ashford, England

[73] Assignee: Seven Towns Limited, London, England

[21] Appl. No.: 574,418

[22] Filed: Jan. 27, 1984

[30] Foreign Application Priority Data

Dec. 1, 1983 [GB] United Kingdom ..... 8331790

[51] Int. Cl.[3] ..... A63F 3/00

[52] U.S. Cl. ..... 273/271

[58] Field of Search ..... 273/271; 434/175

[56] References Cited

U.S. PATENT DOCUMENTS

| | | | |
|---|---|---|---|
| 1,541,795 | 6/1925 | Cress | 434/175 |
| 3,778,063 | 12/1973 | Strand | 273/271 X |
| 4,243,227 | 1/1981 | Strongin | 273/271 X |
| 4,303,246 | 12/1981 | Strongin | 273/271 |
| 4,468,036 | 8/1984 | Istrati | 273/271 |

FOREIGN PATENT DOCUMENTS

| | | | |
|---|---|---|---|
| 2110097 | 6/1983 | United Kingdom | 273/271 |

*Primary Examiner*—Harland S. Skogquist

*Attorney, Agent, or Firm*—Hubbard, Thurman, Turner & Tucker

[57] ABSTRACT

Apparatus for playing a game, comprising a set of playing pieces having at least three distinct identifiable subsets and a playing surface arranged to receive the pieces and maintain them in a row and column matrix with pieces touching adjacent pieces defining the columns of said matrix and with said matrix being filled with less than the set of said pieces, guide means fixed in relation to said playing surface guiding the pieces for movement along the columns between their ends and permitting pieces to enter and leave each column from its ends so that insertion of a piece at one end of the column causes the pieces to be displaced along the column with a piece being discharged from the other end of the column, and means defining a unique direction in which pieces move along each column.

7 Claims, 3 Drawing Figures

APPARATUS FOR PLAYING A GAME

FIELD OF THE INVENTION

This invention relates to apparatus for playing a game based on a matrix of counters.

SUMMARY OF THE INVENTION

Broadly stated the invention provides apparatus for playing a game comprising a set of playing pieces having at least three distinct identifiable subsets, a playing surface arranged to receive the playing pieces and maintain them in a row and column matrix with the pieces touching adjacent pieces defining the columns of said matrix and with said matrix being filled with less than the set of said pieces, guide means fixed in relation to said playing surface guiding the pieces along the columns between their ends and permitting pieces to enter and leave each column from its ends so that insertion of a piece at one end of the column causes the pieces to be displaced along the column with a piece being discharged from the other end of the column, and means defining a unique direction in which pieces move along the columns.

DESCRIPTION OF THE PREFERRED FEATURES

Suitably there may be fifteen pieces divided into five subsets of three, each of similar distinct appearance and the playing surface holds nine pieces at a time in a matrix of three rows and three columns. Rules provide for an initial disposition of nine of the fifteen pieces in the matrix so that each player holds three pieces at any time. His holding may be pieces of three different sets or two pieces of one set and one piece of a different set. The players take alternate turns to insert one of the pieces that they hold into the columns of the matrix, and at the same time recover the piece discharged from the other end of the column. The aim is to build a line of three pieces of the same subset (which may be any one of the five subsets) vertically, horizontally or diagonally. At each move a player has to decide between the six or nine possible moves according to the disposition of the pieces in the playing surface and the effect of each possible move. He has to consider the value to him of the piece that he recovers and the effect on his opponent's strategy bearing in mind the pieces that the opponent holds, which the player can infer or memorise. The game is of intellectual interest and involves a high degree of skill.

The playing pieces may take the form of discs having circumferential grooves, and each column in the playing surface may have tongues defining a slideway that engages the grooves in the pieces to retain the pieces in the playing surface.

The playing surface may conveniently take the form of a generally rectangular frame with stub axles projecting from opposed sides of the frame. A stand may then support the frame with portions thereof defining bearing means for the stub axles, stop means in the stand defining two angular positions of said playing surface presented in opposed angular directions, resilient means in said frame co-operating with means connected to said playing surface to bias said playing surface towards said opposed angular positions.

The frame may carry a roller and the stand may locate a leaf spring that is traversed the compressed by said roller as said frame is moved between one angular position and another with the leaf spring reaching maximum compression when the frame is about midway between said angular positions.

BRIEF DESCRIPTION OF THE DRAWINGS

An embodiment of the invention will now be described, by way of example only, with reference to the accompanying drawings, in which.

DETAILED DESCRIPTION OF A PREFERRED EMBODIMENT

Figure 1:
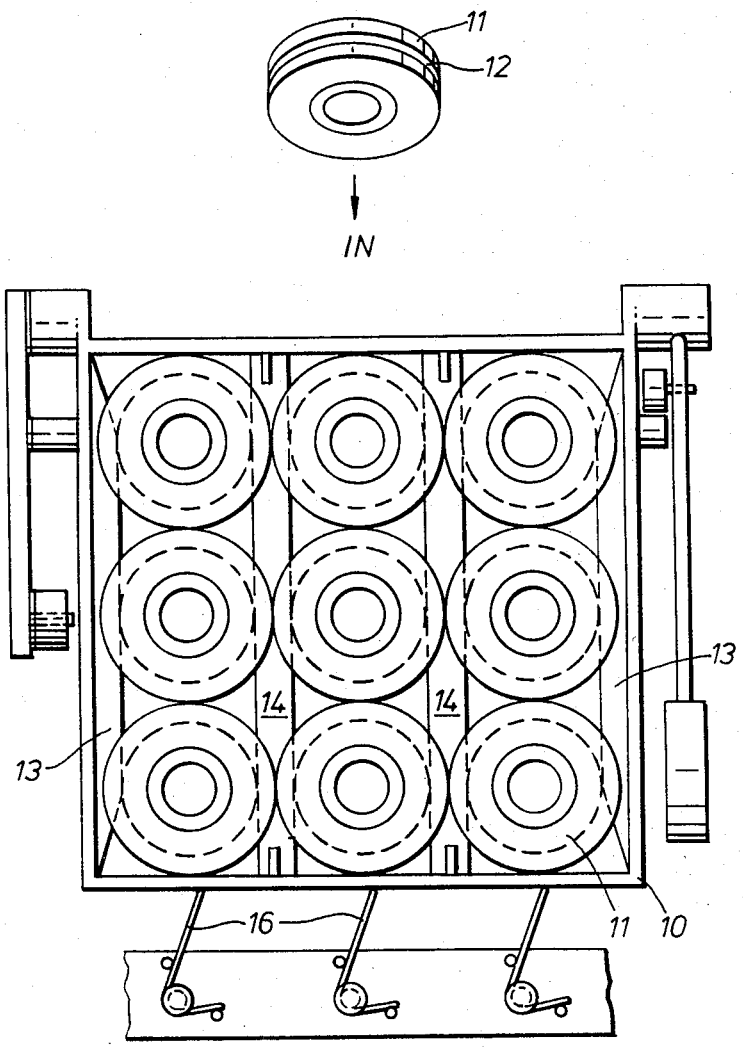
FIG. 1 is a front view of games apparatus according to the invention.

In the drawings, a playing surface is define by a generally square frame 10 that is dimensioned to hold nine counters 11 in a matrix of three rows and three columns. Each counter 11 is in the form of a disc having a circumferential groove 12. Lateral and medial tongues 13, 14 in the frame 10 engage the grooves 12 of the several pieces 11 in the matrix and serve to retain them in the playing surface and slideably guide them for movement along the columns between the ends thereof. During the play of the game the frame 10 is maintained full of counters. There are fifteen of the counters 11 and they are in five differently coloured or marked subsets of three. Thus there are nine of the counters 11 in the frame 10 and the two players hold three counters each. If the colours are red, blue, green, yellow and purple, rules may provide that the playing surface is set up at the start of the game with counters in the following disposition which gives no advantage to either player:

yellow—green—yellow
purple—blue—red
green—yellow—green.

In play there are two players who take alternate turns. Each player inserts one of the pieces that he holds into the top of one of the columns, thereby displacing a piece from the bottom of the column. The player takes the displaced piece and his turn ends. The pieces 11 are normally retained in the playing surface by means of coil springs having radial arms 16 that act as stops for the pieces 11 in the lowest row but can be pushed aside to permit a piece to exit.

The object of the game is to make a horizontal, vertical or diagonal row of three pieces, and a point is given to the player who first does so. Rules may provide that the player who is the first to score 10 points is the winner.

Figures 2, 3:
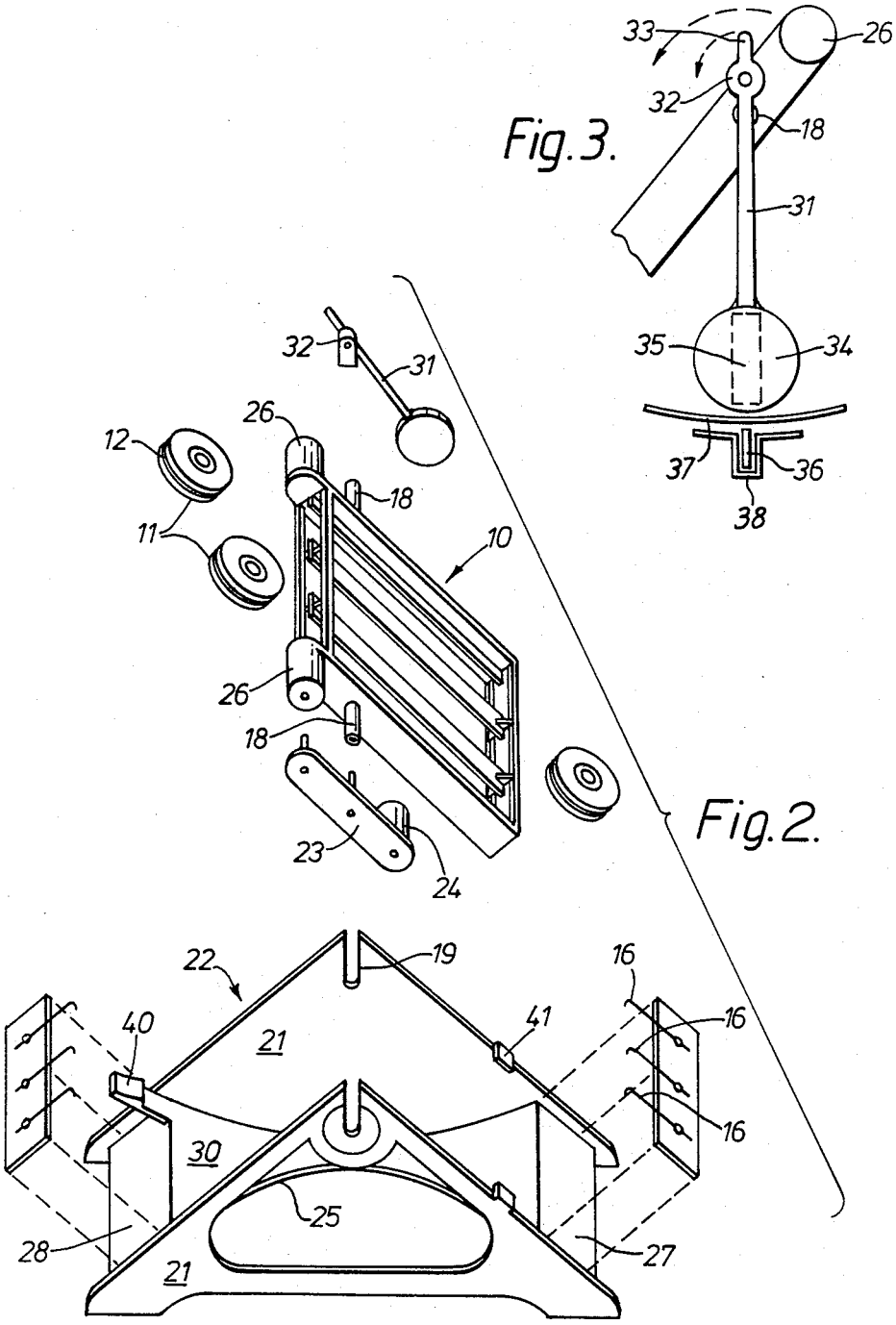
FIG. 2 is an exploded view thereof.
FIG. 3 shows a timing device forming part of the games apparatus.

As is apparent from FIG. 2, the playing surface or frame 10 has stub axles 18 that are supported in bearings 19 at the apices of generally triangular side walls 21 of a stand 22.

The stub axles 18 are located a small distance down the sides of the frame 10. Thereby the frame 10 can be rotated between one playing position to one side of the stand generally denoted by the reference numeral 27 and another playing position to the opposite side of the stand generally denoted by the reference numeral 28. A curved track 30 spans between one wall 21 and another of the stand 22. Operating knobs 26 aligned with its top edge move the frame 10. An arm 23 to one side of the frame 10 is secured thereto by attachment to the operating knob 26 and to the stub axle 18. It carries at its lower end a roller 24 that travels over a leaf spring 25 that is supported in an opening in one of the side walls 21 as shown. The spring 25 applies a load on the roller 24 that tends to return it to one or other of the playing positions 27 or 28. On the other side of the frame 10 is a pendulum 31 pivoted at 32 on an axis above that of the stub axle 18. The pendulum has an arm 33 that is engaged by one of the operating knobs 26 each time that the frame 10 is moved from one playing position to another. The pendulum 31 is thereby displaced a predetermined angle from its rest position. A bob 34 of the pendulum 31 encloses a magnet 35 that at each swing of the pendulum 31 causes a soft iron armature 36 housed in a socket 38 forming part of the stand 22 to impact on a sounding plate 37. Thereby the pendulum makes a approximately constant number of swings at each player's turn. But towards the end of the time for that player the pendulum will now swing ever more slowly past the armature and the intensity of the sound thereby increases, warning the player that his turn is ending and adding to the tension of the game. At the end of the turn the pendulum 31 no longer has enough energy to swing past the armature 36 and the sounds stop abruptly.

The stand is provided at one of the playing positions 27, 28 with a release lever 40 that normally provides an abutment to arrest movement of the frame 10 but can be depressed to allow the frame 10 to be pivoted beyond the playing position for removal and rearrangement of the counters 11 therein at the end of the game. The other playing position has a simple stop or abutment 41.

It will be appreciated that various modifications can be made to the embodiment described above without departing from the invention, the scope of which is defined in the appended claims. For example, the apparatus could take the form of a simple board game in which a matrix of permitted counter positions was defined by markings in an array on one face of the board. Upstanding walls could partition the columns of the matrix and slideably guide the counters. A plinth at one end of the columns could receive the discharged pieces and could be slightly raised from the face of the board. The plinth could terminate in a wall that would serve to limit the movement of the counters in a column on insertion of a fresh counter therein and maintain the counters in each row properly in register. With a simple board game it is not essential that the pieces in all the columns in the matrix move in the same direction, and it is enough if they move in a direction that remains unaltered throughout the game. Arrows on the board could mark the proper direction of movement of the pieces in each column.

I claim:

1. Apparatus for playing a game, comprising a set of playing pieces having at least three distinct identifiable subsets and a playing surface arranged to receive the pieces and maintain them in a row and column matrix with pieces touching adjacent pieces defining the columns of said matrix and with said matrix being filled with less than the set of said pieces, guide means fixed in relation to said playing surface guiding the pieces for movement along the columns between their ends and permitting pieces to enter and leave each column from its ends so that insertion of a piece at one end of the column causes the pieces to be displaced along the column with a piece being discharged from the other end of the column, and means defining a unique direction in which pieces move along each column.

2. Apparatus according to claim 1, wherein there is a set of fifteen pieces divided into five subsets of three pieces of similar appearance, and the playing surface holds nine pieces at a time in a matrix of three rows and three columns.

3. Apparatus according to claim 1, wherein the pieces are in the form of discs having circumferential grooves and the columns are separated by tongues that engage in the grooves to retain the pieces in the playing surface while permitting them to be displaced along the columns.

4. Apparatus according to claim 1, wherein the playing surface is a generally rectangular frame, stub axles project from opposite sides of the frame, a stand rotatably supports said frame with portions thereof defining bearing means for said stub axles, stop means in said stand defining two angular positions of said playing surface in which it faces in opposed angular directions, and resilient means in said stand biases said playing surface towards one or the other of said angular directions.

5. Apparatus according to claim 4, wherein said frame carries a roller, a leaf spring in the stand is traversed and compressed by said roller as said frame is moved between one angular position and another, with said leaf spring reaching its maximum compression when said frame is midway between said angular positions.

6. Apparatus according to claim 5, wherein a bearing surface within said stand of arcuate profile supports the playing pieces as the frame is moved from one angular position to another, and at each of said angular positions the playing pieces in each column of the playing surface are retaining by resilient fingers that intrude into the base of each column and may be moved aside as fresh pieces are inserted into the playing surface to permit pieces to be discharged.

7. Apparatus according to claim 6, wherein means on said frame is arranged to displace a pendulum as said frame is moved from one angular position to another, said pendulum having a bob and a magnet in the bob, and said stand having an armature that is moved every time that it is passed by said pendulum to impact against a sounding plate.

* * * * *